US005690132A

United States Patent [19]

Lin et al.

[11] Patent Number: 5,690,132

[45] Date of Patent: Nov. 25, 1997

[54] CATCH-FREE SAFETY UMBRELLA

[75] Inventors: Chung-Kuang Lin; Jung-Jen Chang, both of Taipei Hsien, Taiwan

[73] Assignee: Fu Tai Umbrella Works, Ltd., Taipei Hsein, Taiwan

[21] Appl. No.: 773,115

[22] Filed: Dec. 26, 1996

[51] Int. Cl.[6] ..... A45B 25/14

[52] U.S. Cl. ..... 135/24; 135/38; 135/28

[58] Field of Search ..... 135/22–24, 28, 135/25.33, 37, 38, 39, 40

[56] References Cited

U.S. PATENT DOCUMENTS

| | | | |
|---|---|---|---|
| 4,534,374 | 8/1985 | Day | 135/24 X |
| 4,573,487 | 3/1986 | Schultes et al. | 135/24 |
| 4,682,616 | 7/1987 | Schultes | 135/22 X |
| 4,682,617 | 7/1987 | Schultes et al. | 135/22 X |
| 4,802,499 | 2/1989 | Lisack | 135/24 |
| 4,823,821 | 4/1989 | Day | 135/24 |
| 4,989,625 | 2/1991 | Wu | 135/24 X |
| 5,036,872 | 8/1991 | Huang | 135/24 X |
| 5,357,994 | 10/1994 | Chung | 135/22 |

FOREIGN PATENT DOCUMENTS

| | | | |
|---|---|---|---|
| 2253184 | 5/1973 | Germany | 135/24 |

*Primary Examiner*—Lanna Mai

[57] ABSTRACT

A safety umbrella includes: a lower runner for pivotally connecting the ribs of the umbrella slidably held on a central shaft of the umbrella and formed with a latch hole in the lower runner; a controller formed in a grip of the central shaft having a push button normally protruding outwardly from the grip, and a latch connectable with the push button and resiliently urged by a restoring spring retained in the grip for operatively engaging the latch hole in the lower runner for locking the lower runner and the ribs at a folded condition, to thereby eliminate a long slot cut in the shaft above the grip to prevent deformation or damage of the shaft and to eliminate the acute spring catch formed in the shaft to prevent injury to the umbrella user as stuck by the conventional spring catch.

1 Claim, 4 Drawing Sheets

CATCH-FREE SAFETY UMBRELLA

BACKGROUND OF THE INVENTION

A conventional umbrella as shown in FIG. 6 includes a lower runner L slidably held on a central shaft S, a spring catch C resiliently secured in a hollow tube portion of the shaft S above the grip G of the umbrella, whereby when lowering the runner L to allow the hook H of the catch C to engage a hook hole L1 cut in the runner L with the hook H protruding outwardly through a hook hole S1 formed in the central shaft S, the runner L with its pivotally connected ribs R will be locked at a folded condition of the umbrella. Upon depression of a push button P formed on the catch C which is protruded outwardly through the button hole S2 formed in the shaft S to disengage the hook H from the hook hole L1 formed in the runner L, the umbrella can then be opened by upwardly raising the runner 1.

However, the central shaft S is cut with a lengthy slot for forming the hook hole S1 and the button hole S2 to thereby weaken the strength of the central shaft S, easily being deformed, damaged or even broken especially when subjected to a larger external force. Meanwhile, the hole S1, S2 cut in the shaft S to protrude the acute hook H or catch C may easily stick or injure an umbrella user. The push button P is positioned above the grip 12 to influence a depression of the button P when the user's hand already holds the grip 12, causing a depression inconvenience.

The present inventors have found the drawbacks of the conventional umbrella, and invented the present safety umbrella to improve or overcome the drawbacks of the conventional umbrella.

SUMMARY OF THE INVENTION

The object of the present invention is to provide a safety umbrella including: a lower runner for pivotally connecting the ribs of the umbrella slidably held on a central shaft of the umbrella and formed with a latch hole in the lower runner; a controller formed in a grip of the central shaft having a push button normally protruding outwardly from the grip, and a latch connectable with the push button and resiliently urged by a restoring spring retained in the grip for operatively engaging the latch hole in the lower runner for locking the lower runner and the ribs at a folded condition, to thereby eliminate a long slot cut in the shaft above the grip to prevent deformation or damage of the shaft and to eliminate the acute spring catch formed in the shaft to prevent injury to the umbrella user as stuck by the conventional spring catch.

DETAILED DESCRIPTION

Figure 1:
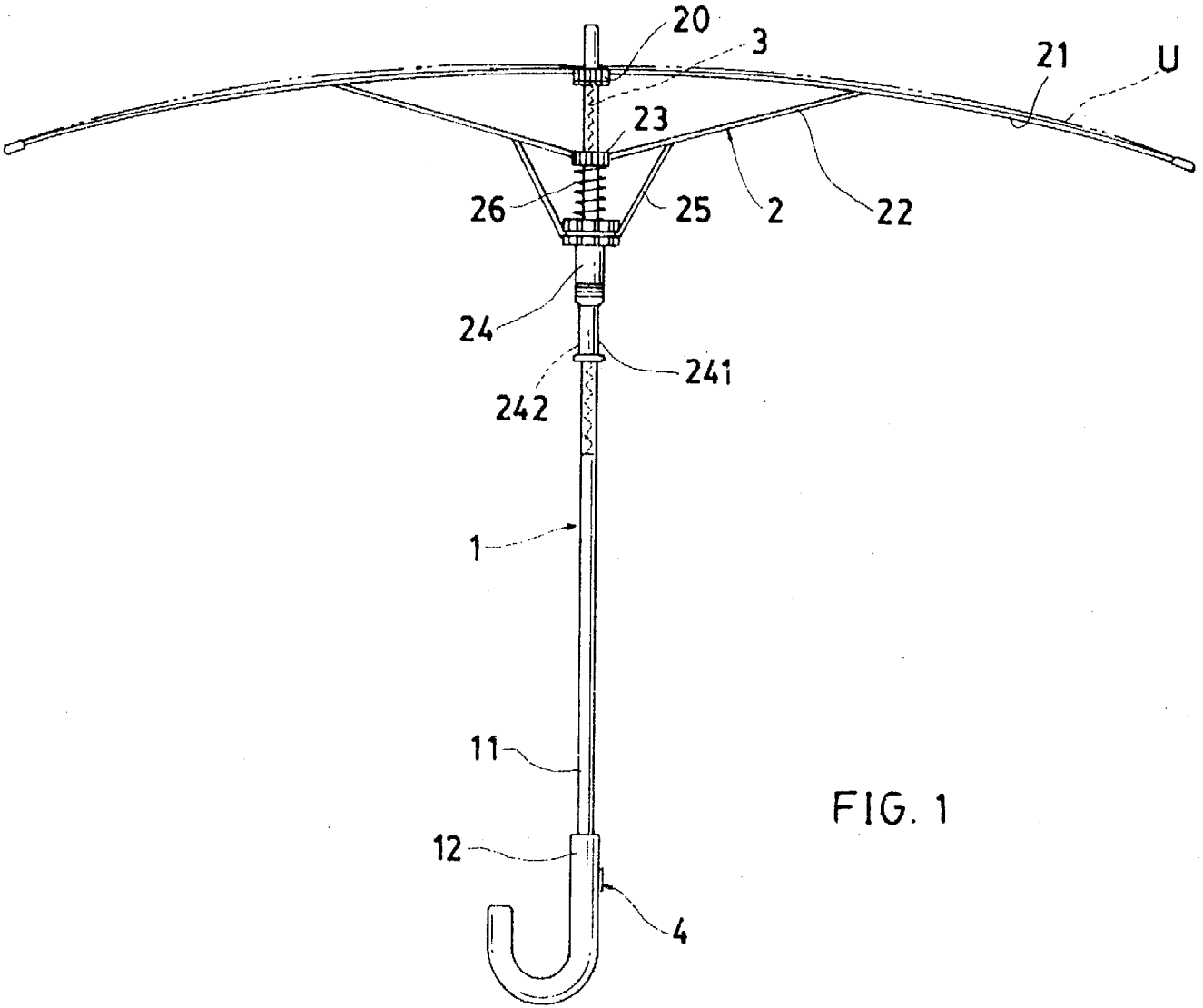
FIG. 1 is an illustration showing an opened umbrella of the present invention.
Figure 2:
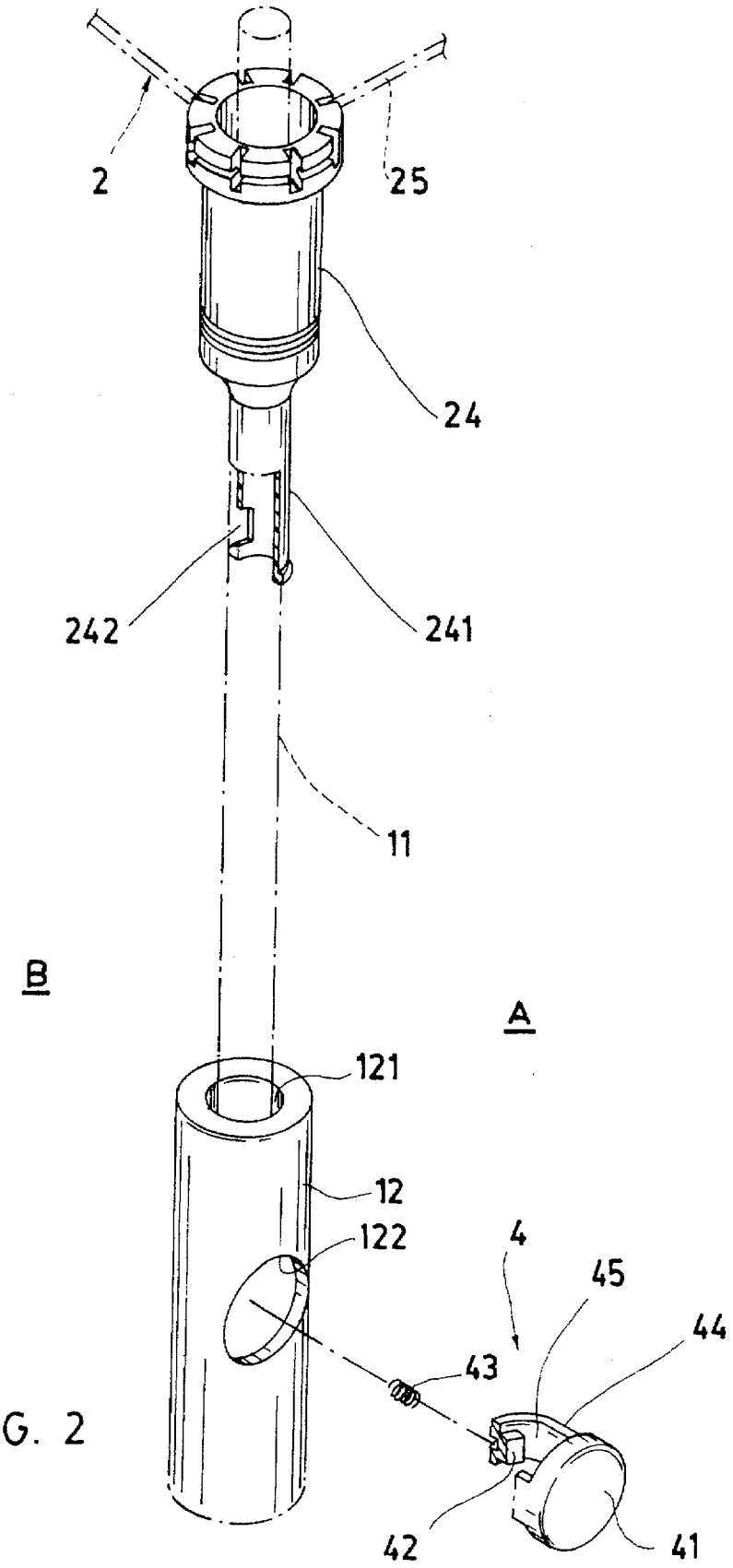
FIG. 2 is a partial perspective view of the present invention.

As shown in FIGS. 1–4, a preferred embodiment of the safety umbrella of the present invention comprises: a central shaft 1 having a grip 12 formed on a lower tube 11 of the central shaft 1; a rib means 2 for securing an umbrella cloth U thereon including at least a top rib 21 pivotally secured to an upper notch 20 formed on a top portion of the shaft 1, a stretcher rib 22 pivotally connected between the top rib 21 and a middle runner 23 slidably held on the shaft 1, an auxiliary rib 25 pivotally connected between the stretcher rib 22 and a lower runner 24 slidably held on the shaft 1 and positioned below the middle runner 23 having a tension spring 26 resiliently retained between the two runners 23, 24; an opening spring 3 resiliently held in the central shaft 1 for opening the umbrella; and a control means 4 formed in the grip 12 of the central shaft 1. Other rib means 2 may be modified and not limited in this invention.

The lower runner 24 includes an extending sleeve 241 protruding downwardly from the lower runner 24 having a latch hole 242 cut in the extending sleeve 241.

In order to absorb any vibrational shock caused by an external force impacting the central shaft 1, the grip 12 of the present invention is preferably made of plastic or other elastomer materials. However, the materials for making the elements of the present invention are not limited.

If the middle runner 23 is omitted in this invention, the lower runner 24 may then be simply designated as "runner" or other suitable names.

Figure 3:
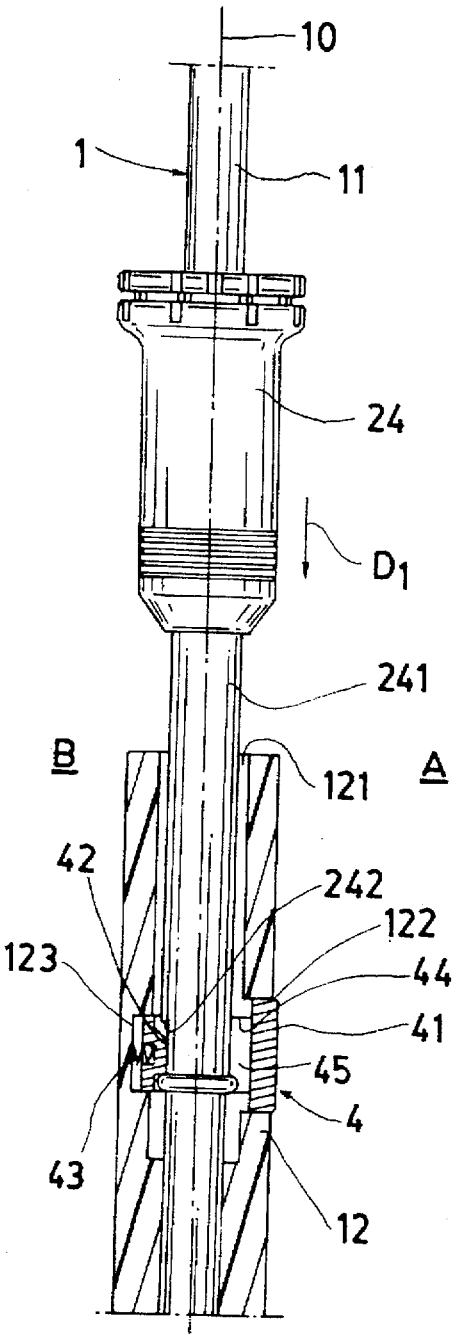
FIG. 3 is a sectional drawing showing a locked runner according to the present invention.

The control means 4 includes: a push button 41 slidably and resiliently held in a button hole 122 transversely formed in a middle portion of the grip 12 adjacent to a first side A of the grip 12, a latch 42 resiliently held in the grip 12 adjacent to a second side B of the grip (opposite to the first side A of the grip) for operatively engaging the latch hole 242 formed in the extending sleeve 241 of the lower runner 24 when lowering the lower runner 24 for folding the umbrella as shown in FIG. 3, a restoring spring 43 resiliently retained in a spring socket 123 recessed in the grip 12 adjacent to the second side B of the grip 12 for normally urging the latch 42 towards an axis 10 of the central shaft 1 for engaging the latch 42 with the latch hole 242 formed in the lower runner 24, and a transmission member 44 connected between the push button 41 and the latch 42 and slidably transversely formed in the button hole 122 of the grip 12 having a vertical hole 45 vertically formed in the transmission member 44 for slidably disposing around the extending sleeve 241 of the lower runner 24 when downwardly slid to allow the engagement of the latch 42 with the latch hole 242 formed in the extending sleeve 241. The push button 41 as connected with the latch 42 is normally protruded outwardly towards the first side A as also urged by the restoring spring 43, ready for a depression D by an umbrella user.

The grip 12 is formed with a central hole 121 recessed in an upper portion of the grip 12 for inserting the extending sleeve 241 of the lower runner 24 when lowered for folding the umbrella. The inside diameter of the central hole 121 in the grip 12 should be slightly larger than an outside diameter of the extending sleeve 241 of the lower runner 24 which is slidably disposed about the lower tube 11 of the central shaft 1.

As shown in FIG. 3, when closing or folding the umbrella by lowering (D1) the runner 24 and the extending sleeve 241, the latch hole 242 will be engaged with the latch 42 resiliently held in the spring socket 123 formed in the grip 12 to lock the runner 24 at its folded state.

Figure 4:
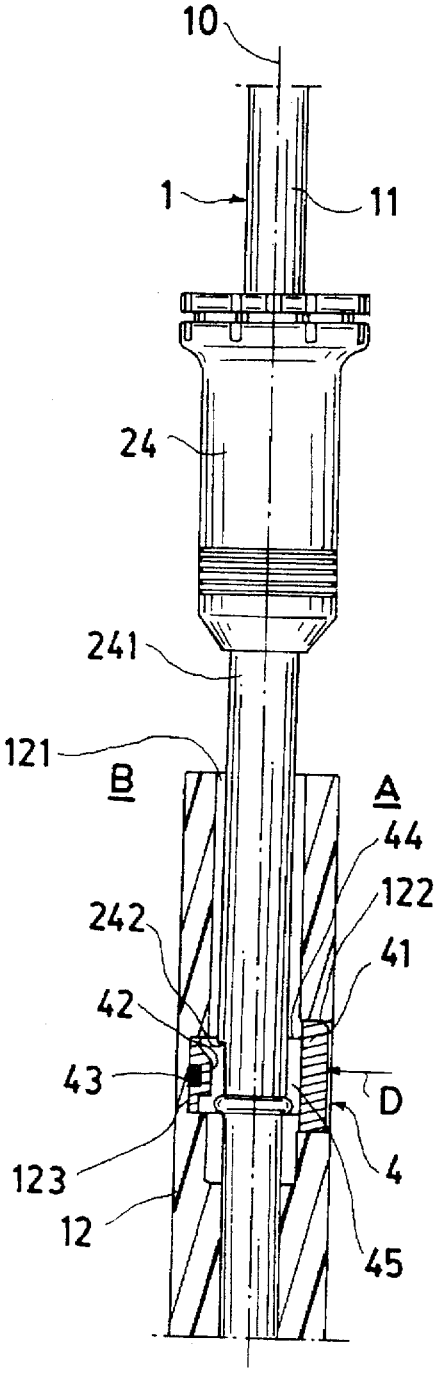
FIG. 4 shows a step for opening the umbrella of the present invention from FIG. 3.
Figure 6:
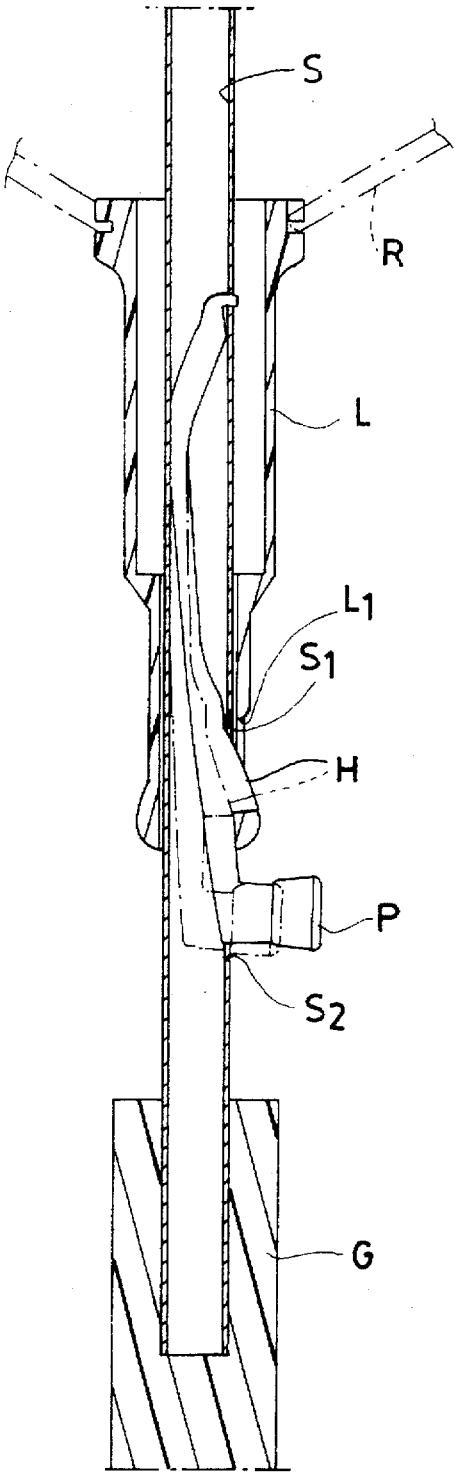
FIG. 6 PRIOR ART
FIG. 6 shows a conventional umbrella structure.

Upon depression D of the push button 41 as shown in FIG. 4, the latch hole 242 in the extending sleeve 241 of the lower runner 24 will be disengaged from the latch 42 which is simultaneously retracted towards the second side B of the grip 12 when the push button 41 is inwardly depressed D towards the second side B of the grip 12, the lower runner 24 is now disengaged from the latch 42 and the umbrella rib means 2 and the runner 24 will be extended upwardly by the opening spring 3 or by manual force to thereby open the umbrella as shown in FIG. 1.

The lower tube 11 of the central shaft 1 above the grip 12 is not cut with conventional catch or hook hole in the central shaft 1 to thereby prevent any deformation or damage of the shaft 1 since the strength of the shaft 1 is not reduced in the absence of any slot or hole cut therein.

The outward protrusion of a conventional acute catch or hook beyond the outer surface of the shaft 1 no longer exists, the sticking or injury to the umbrella user will then be prevented, thereby enhancing the safety of the umbrella.

Figure 5:
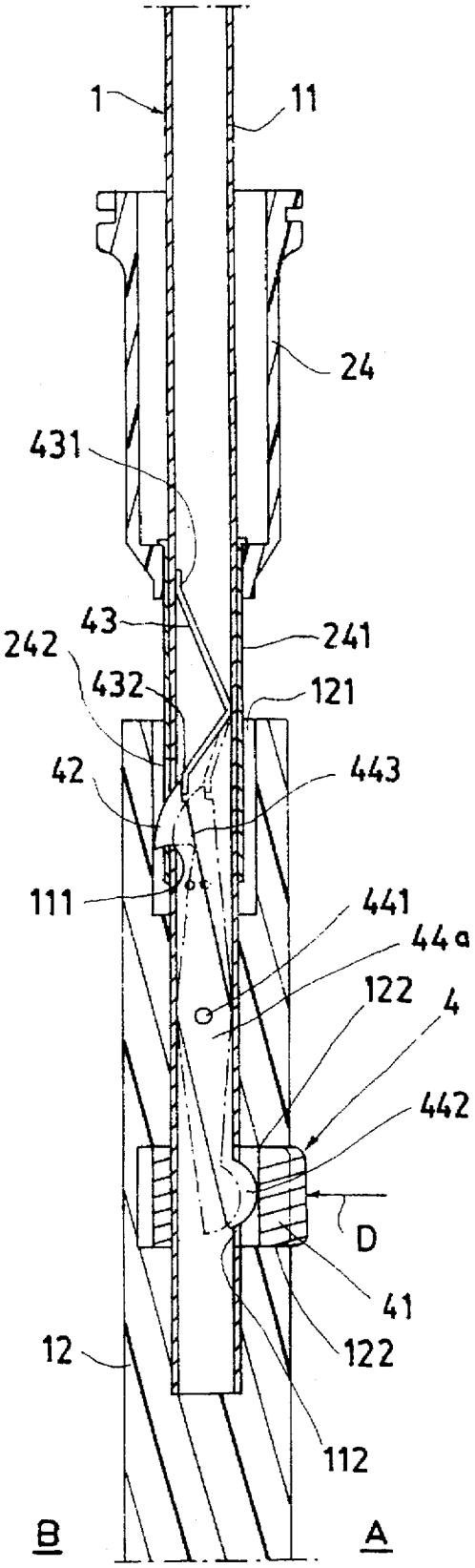
FIG. 5 shows another preferred embodiment of the present invention.

Another preferred embodiment of the present invention is shown in FIG. 5 by modifying the first embodiment as shown in FIGS. 1–4.

The control means 4 includes: a push button 41 slidably held in a button hole 122 transversely formed in the grip 12 adjacent to a first side A of the grip 12; a latch 42 resiliently held in a hollow lower tube 11 of the central shaft 1 to normally resiliently protrude outwardly through an inner latch hole 111 formed in the lower tube 11 to be confined in the central hole 121 within the grip 12 towards the second side B of the grip 12 opposite to the first side A of the grip; a restoring spring 43 resiliently retained in the lower tube 11 for normally urging the latch 42 outwardly for engaging the latch hole 242 formed in the extending sleeve 241 of the lower runner 24 when folding the umbrella by lowering the extending sleeve 241 of the lower runner 24 into the central hole 121 of the grip 12; and a transmission member **44*a* seesawly pivotally mounted in the lower tube 11 by a pivot 441 having a depression end 442 formed on a lower end of the transmission member 44*a* and protruding towards the first side A of the grip 12 through a lower hole 112 formed in the lower tube 11 to be opposite to the latch end 443 and to be normally contacted with the push button 41, and having a latch end 443 formed on an upper end of the transmission member 44*a* to connect the latch 42, with the latch 42 and the latch end 443 of the transmission member 44*a* normally resiliently urged by restoring spring 43 to protrude the latch 42 outwardly towards the second side of the grip and to seesawly bias the depression end 442 formed on the lower end of the transmission member 44*a* outwardly towards the first side A of the grip to simultaneously urge the push button 41 outwardly beyond the button hole 122 of the grip 12**, ready for a depression D by an umbrella user for opening the umbrella from its folded or closed state.

After lowering the runner 24 and its extending sleeve 241 downwardly into the central hole 121 in the grip 12 to engage the latch hole 242 with the latch 42 as urged by the restoring spring 43, the runner 24 will be locked at a folding condition of the umbrella. Upon depression D of the push button 41, the latch 42 will be inwardly biased by the seesaw action of the transmission member **44*a* to disengage from the latch hole 242, thereby unlocking the extending sleeve 241 and the runner 24** and allowing the opening of the umbrella.

The restoring spring 43 as shown in FIG. 5 includes a fixed spring end 431 secured in the lower tube 11 of the central shaft 1, and an actuating spring end 432 formed on a distal end of the spring 43 opposite to the fixed spring end 431 for resiliently urging the latch 42 outwardly in order to catch the latch hole 242 of the runner 24 when closing the umbrella.

The present invention may be modified without departing from the spirit and scope of the present invention. The present invention may be used for automatic umbrella, or manually operated umbrella, not limited.

I claim:

1. A safety umbrella comprising:

a central shaft having a grip formed on a hollow lower tube of the central shaft, said grip having a central hole formed in an upper central portion of said grip;

a rib means for securing an umbrella cloth thereon having a runner of the rib means slidably held on said central shaft; and a control means formed in the grip for controlling the opening or closing of the umbrella;

the improvement which comprises:

said runner including an extending sleeve protruding downwardly from said runner having a latch hole formed in the extending sleeve; and said control means including: a push button slidably held in a button hole transversely formed in the grip adjacent to a first side of the grip; a latch resiliently held in said lower tube of the central shaft to normally resiliently protrude outwardly through an inner latch hole formed in the lower tube to be confined in the central hole within the grip towards the second side of the grip opposite to the first side of the grip; a restoring spring resiliently retained in the lower tube for normally urging the latch outwardly for engaging the latch hole formed in the extending sleeve of the lower runner when folding the umbrella by lowering the extending sleeve of the lower runner into the central hole of the grip; and a transmission member seesawly pivotally mounted in the lower tube by a pivot having a depression end formed on a lower end of the transmission member and protruding towards the first side of the grip to be opposite to the latch end and to be normally contacted with the push button, and having a latch end formed on an upper end of the transmission member to connect the latch, with the latch and the latch end of the transmission member normally resiliently urged by the restoring spring to protrude the latch outwardly towards the second side of the grip and to seesawly bias the depression end formed on the lower end of the transmission member outwardly towards the first side of the grip to simultaneously urge the push button outwardly beyond the button hole of the grip, ready for a depression by an umbrella user for opening the umbrella from a folded or closed umbrella.

* * * * *